US009970700B2

(12) United States Patent
Cho et al.

(10) Patent No.: US 9,970,700 B2
(45) Date of Patent: May 15, 2018

(54) COOLING APPARATUS AND CONTROL METHOD THEREOF

(71) Applicant: Samsung Electronics Co., Ltd., Suwon-si (KR)

(72) Inventors: Sung Ho Cho, Gwangju (KR); Woo Sung Kim, Hwaseong-si (KR); Won Je Lee, Gwangju (KR); Yong Han Kim, Cheonan-si (KR); Jung Won Park, Gwangju (KR); Seong Wook Jeong, Gwangju-si (KR); Sang Youl Cha, Gwangju (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 827 days.

(21) Appl. No.: 14/010,905

(22) Filed: Aug. 27, 2013

(65) Prior Publication Data

US 2014/0053581 A1 Feb. 27, 2014

(30) Foreign Application Priority Data

Aug. 27, 2012 (KR) ..... 10-2012-0093964

(51) Int. Cl.
*F25D 21/06* (2006.01)
*G05D 23/32* (2006.01)
*F25D 21/00* (2006.01)

(52) U.S. Cl.
CPC ..... *F25D 21/008* (2013.01); *F25D 21/006* (2013.01); *F25B 2600/01* (2013.01);
(Continued)

(58) Field of Classification Search
CPC ..... F25B 47/02; F25B 2347/022; F25B 2347/02; F25B 2600/01; F25B 2600/11;
(Continued)

(56) References Cited

U.S. PATENT DOCUMENTS 3,845,637 A * 11/1974 Shepherd ..... F25D 17/065 62/155
3,854,915 A * 12/1974 Schulze-Berge ..... F25D 21/002 62/155

(Continued)

FOREIGN PATENT DOCUMENTS

KR 10-0708622 4/2007

OTHER PUBLICATIONS

Extended European Search Report dated Oct. 7, 2016 in European Patent Application No. 13181732.2.

*Primary Examiner* — Ned Landrum
*Assistant Examiner* — Daniel C Comings
(74) *Attorney, Agent, or Firm* — Staas & Halsey LLP

(57) ABSTRACT

A cooling apparatus includes a storage compartment, an evaporator to cool air in the storage compartment by evaporating a refrigerant, a compressor to compress the refrigerant evaporated by the evaporator, an air blower to supply the air cooled by the evaporator to the storage compartment and to remove frost formed on the evaporator, a storage temperature sensor to sense a temperature of the storage compartment, a driving unit to drive the compressor and the air blower, and a controller to perform a defrosting operation of operating the air blower to remove frost formed on the evaporator when a cooling operation of cooling the storage compartment is terminated and to perform the cooling operation, wherein the controller defers, when the defrosting operation is being performed, operation of the compressor, even if the temperature of the storage compartment is greater than or equal to the storage upper limit temperature.

18 Claims, 11 Drawing Sheets

(52) U.S. Cl.
CPC ..... *F25D 21/002* (2013.01); *F25D 2700/10* (2013.01); *F25D 2700/12* (2013.01); *F25D 2700/14* (2013.01)

(58) Field of Classification Search
CPC ..... F25B 2600/112; F25B 2600/23; F25D 21/008; F25D 21/002; F25D 21/006
USPC ..... 62/151, 155, 159, 158, 234
See application file for complete search history.

(56) References Cited

U.S. PATENT DOCUMENTS

| | | | | |
|---|---|---|---|---|
| 4,065,938 | A * | 1/1978 | Jonsson | F25B 13/00 237/2 B |
| 5,355,686 | A * | 10/1994 | Weiss | F25D 17/065 62/158 |
| 7,234,516 | B2 * | 6/2007 | Umebayashi | B60H 1/00692 165/103 |
| 2002/0139132 | A1 * | 10/2002 | Collins | F25D 21/006 62/156 |
| 2008/0092569 | A1 * | 4/2008 | Doberstein | F25D 21/006 62/156 |

* cited by examiner

COOLING APPARATUS AND CONTROL METHOD THEREOF

CROSS-REFERENCE TO RELATED APPLICATIONS

This application claims the priority benefit of Korean Patent Application No. 10-2012-0093964, filed on Aug. 27, 2012 in the Korean Intellectual Property Office, the disclosure of which is incorporated herein by reference.

BACKGROUND

1. Field

The following description relates to a cooling apparatus which performs a defrosting operation using an air blower, and a control method thereof.

2. Description of the Related Art

A cooling apparatus is an appliance that keeps articles such as food and drinks fresh for a long period of time. The cooling apparatus is generally provided with a refrigeration compartment to keep articles in a cooled state and a freezer compartment to keep articles in a frozen state.

The cooling apparatus repeatedly performs a refrigeration cycle including compression, condensation, expansion, and evaporation of a refrigerant to maintain the temperature of a storage compartment at an established target temperature. That is, the cooling apparatus supplies air cooled by an evaporator provided for each storage compartment to the storage compartment based on the target temperature of the storage compartment such that the temperature of the storage compartment is maintained at the target temperature.

While the air is cooled by evaporating the refrigerant in the evaporator, frost is formed on the evaporator. To remove the frost from the evaporator, the cooling apparatus is provided with a defrosting heater.

However, in the case that the defrosting heater is provided to every evaporator provided to each storage compartment to remove frost from the evaporators, overall power consumption of the cooling apparatus may increase.

SUMMARY

Therefore, it is an aspect of the present disclosure to provide a cooling apparatus which defrosts an evaporator using an air blower which supplies cooled air to the storage compartment.

Additional aspects of the disclosure will be set forth in part in the description which follows and, in part, will be obvious from the description, or may be learned by practice of the invention.

In accordance with an aspect of the present disclosure, a cooling apparatus includes a storage compartment to store articles in a cooled state, an evaporator to cool air in the storage compartment by evaporating a refrigerant, a compressor to compress the refrigerant evaporated by the evaporator, an air blower to supply the air cooled by the evaporator to the storage compartment, a storage temperature sensor to sense a temperature of the storage compartment, and a controller to perform a cooling operation of cooling the storage compartment when the temperature of the storage compartment is greater than or equal to a storage upper limit temperature and to perform a defrosting operation of operating the air blower to remove frost formed on the evaporator when the cooling operation is terminated, wherein the defrosting operation is performed for at least a minimum defrosting time, and when a defrosting time for which the defrosting operation is performed is less than the minimum defrosting time, the cooling operation is deferred even if the temperature of the storage compartment is greater than or equal to the storage upper limit temperature.

The controller may terminate the cooling operation and perform the defrosting operation, when the temperature of the storage compartment is less than or equal to a storage lower limit temperature.

The cooling apparatus may further include an external air temperature sensor to sense a temperature of external air outside of the storage compartment, wherein the minimum defrosting time may be changed according to the temperature of the external air sensed by the external air temperature sensor.

The minimum defrosting time may decrease when the temperature of the external air increases.

The defrosting operation may be terminated when the temperature of the storage compartment is greater than or equal to the storage upper limit temperature and the minimum defrosting time elapses.

The cooling apparatus may further include a defrosting temperature sensor to sense a temperature of the evaporator, wherein the defrosting operation may be terminated when the temperature of the evaporator sensed by the defrosting temperature sensor is greater than or equal to a defrosting termination temperature.

The defrosting operation may be terminated when a maximum defrosting time elapses.

The controller may terminate the cooling operation and perform the defrosting operation, when a continuous operation time of the compressor is greater than or equal to a maximum cooling time.

The cooling apparatus may further include a defrosting temperature sensor to sense a temperature of the evaporator, wherein the defrosting operation may be terminated when the temperature of the evaporator sensed by the defrosting temperature sensor is greater than or equal to a defrosting termination temperature.

The defrosting operation may be terminated when a maximum defrosting time elapses.

In accordance with an aspect of the present disclosure, a control method of a cooling apparatus including a storage compartment, an evaporator to cool air in the storage compartment by evaporating a refrigerant, a compressor to compress the refrigerant evaporated by the evaporator, and an air blower to supply the air cooled by the evaporator to the storage compartment, includes performing a cooling operation of cooling the storage compartment when the temperature of the storage compartment is greater than or equal to a storage upper limit temperature, terminating the cooling operation when the temperature of the storage compartment is less than or equal to a storage lower limit temperature, and performing a defrosting operation of operating the air blower to remove at least frost formed on the evaporator when the cooling operation is terminated, wherein the defrosting operation is performed for at least a minimum defrosting time, and when a defrosting time for which the defrosting operation is performed is less than the minimum defrosting time, the cooling operation is deferred even if the temperature of the storage compartment is greater than or equal to the storage upper limit temperature.

The minimum defrosting time may be changed according to a temperature of external air outside of the storage compartment.

The minimum defrosting time may decrease when the temperature of the external air increases.

The control method may further include terminating the defrosting operation when the temperature of the storage compartment is greater than or equal to the storage upper limit temperature and the minimum defrosting time elapses.

The control method may further include terminating the defrosting operation when a temperature of the evaporator is greater than or equal to a defrosting termination temperature.

The control method may further include terminating the defrosting operation when a maximum defrosting time elapses.

The control method may further include terminating the cooling operation when a continuous operation time of the compressor is greater than or equal to a maximum cooling time, and performing the defrosting operation of operating the air blower.

The control method may further include terminating the defrosting operation when the minimum defrosting time elapses and the temperature of the evaporator is greater than or equal to a defrosting termination temperature.

The control method may further include terminating the defrosting operation when a maximum defrosting time elapses.

In accordance with an aspect of the present disclosure, a cooling apparatus includes a refrigeration compartment to store articles in a cooled state, a freezer compartment spatially separated from the refrigeration compartment to store articles in a frozen state, a first evaporator to cool the refrigeration compartment, a second evaporator to cool the freezer compartment, a compressor to compress a refrigerant evaporated by the first evaporator and the second evaporator, a first air blower to supply air cooled by the first evaporator to the refrigeration compartment, a second evaporator defrosting heater to remove frost formed on the second evaporator, and a controller to operate the air blower to perform a first defrosting operation of removing frost formed on the first evaporator when a first cooling operation of cooling the refrigeration compartment is terminated and to operate the second evaporator defrosting heater to perform a second defrosting operation of removing the frost formed on the second evaporator when a second cooling operation of cooling the freezer compartment is terminated, wherein a first evaporator defrosting heater to remove the frost formed on the first evaporator is not provided, and the controller performs the first defrosting operation for at least a minimum defrosting time, and defers the first cooling operation until the minimum defrosting time elapses.

The controller may terminate the first cooling operation and perform the first defrosting operation, when a temperature of the refrigeration compartment is less than or equal to a refrigeration lower limit temperature during the first cooling operation.

The cooling apparatus may further include an external air temperature sensor to sense a temperature of external air outside of the refrigeration compartment and the freezer compartment, wherein the controller changes the minimum defrosting time according to the temperature of the external air.

The controller may terminate the first defrosting operation, when the minimum defrosting time elapses, and the temperature of the refrigeration compartment is greater than or equal to a refrigeration upper limit temperature.

The cooling apparatus may further include a defrosting temperature sensor to sense a temperature of the first evaporator, wherein the controller may terminate the first defrosting operation, when the temperature of the evaporator is greater than or equal to a defrosting termination temperature and the minimum defrosting time elapses.

The controller may terminate the first defrosting operation when a maximum defrosting time elapses.

The controller may terminate the first cooling operation and the second cooling operation and perform the first defrosting operation and the second defrosting operation, when a continuous operation time of the compressor is greater than or equal to a maximum cooling time.

In accordance with an aspect of the present disclosure, a refrigerator may include an evaporator to cool air, an air blower to supply the cooled air to an interior of the refrigerator, and a controller to control a cooling cycle to maintain a temperature of the interior of the refrigerator below a predetermined upper limit temperature using the evaporator and blower, and to control a defrosting cycle to defrost the evaporator using the air blower, where the defrosting cycle is maintained for a minimum defrosting time.

The minimum defrosting time may be variable.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
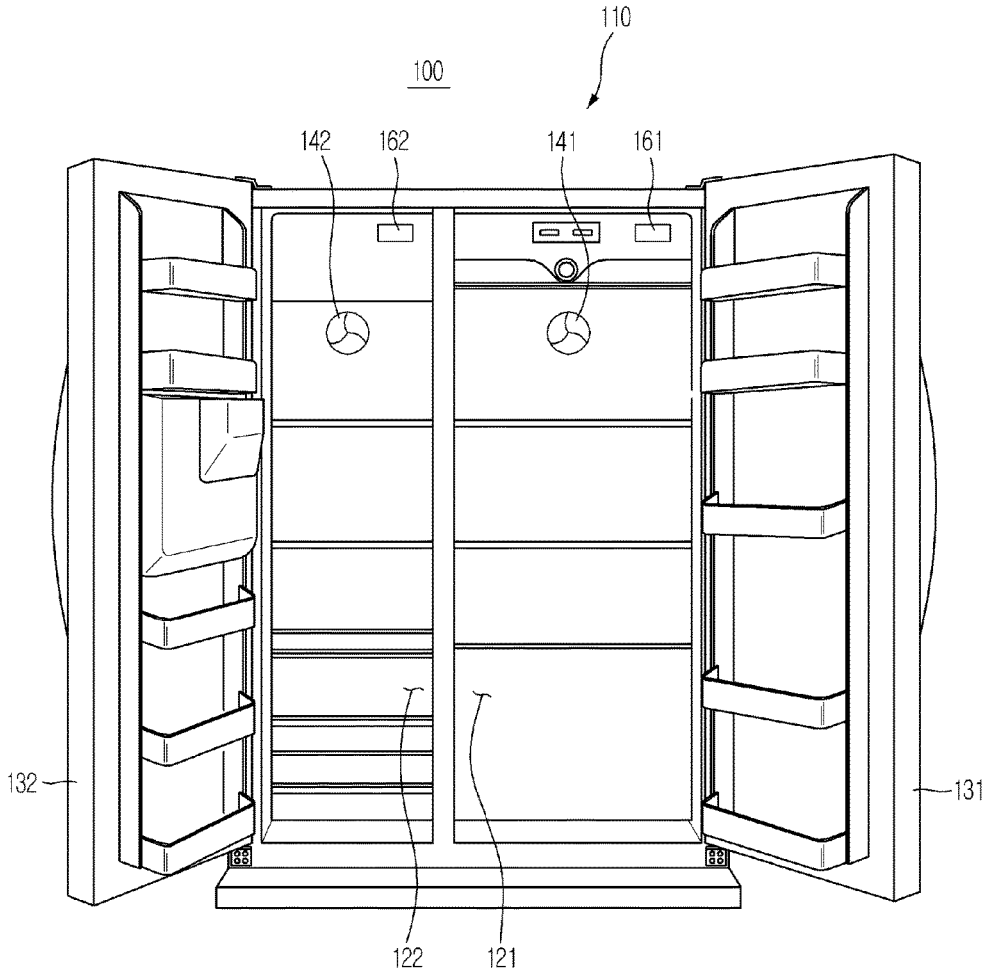
FIG. 1 is a front view showing a cooling apparatus according to an embodiment of the present disclosure.

Reference will now be made in detail to the embodiments of the present disclosure, examples of which are illustrated in the accompanying drawings, wherein like reference numerals refer to like elements throughout.

Figure 2:
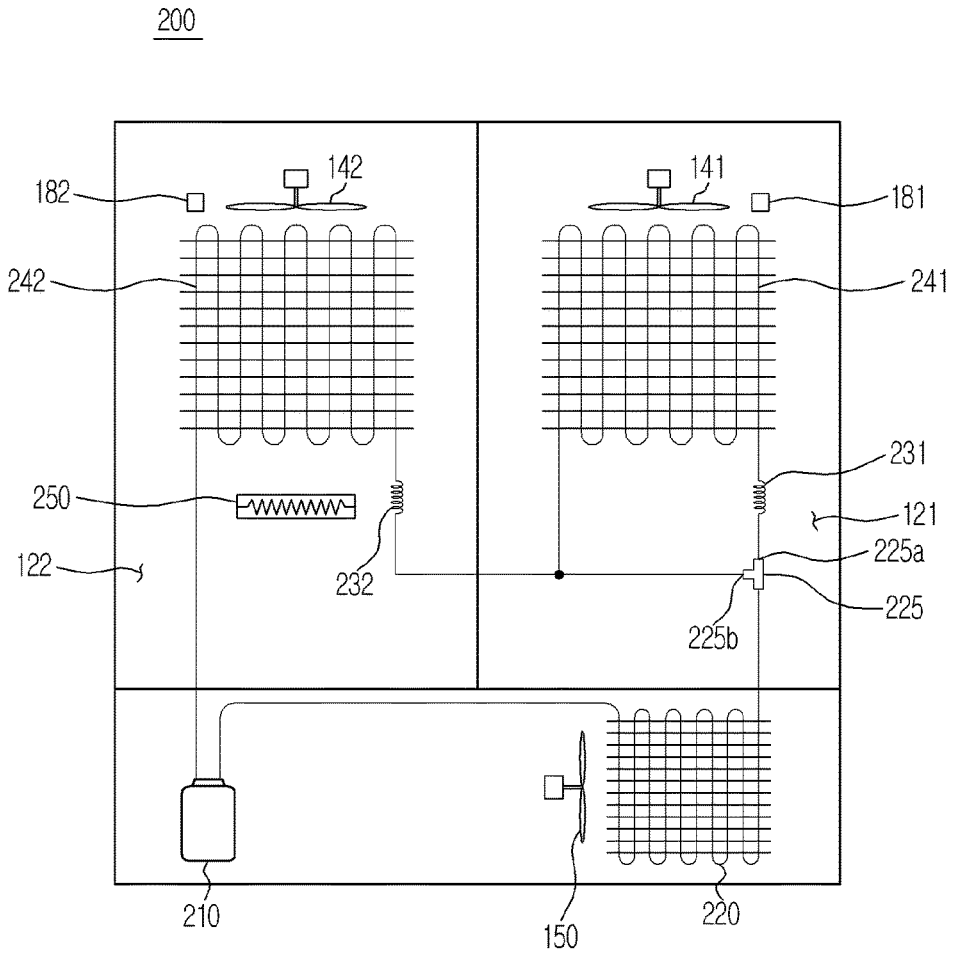
FIG. 2 is a view showing a cooling unit configuring the cooling apparatus according to the illustrated embodiment.

FIG. 1 is a front view showing a cooling apparatus 100 according to an embodiment of the present disclosure, and FIG. 2 is a view showing a cooling unit 200 configuring the cooling apparatus according to the illustrated embodiment.

Referring to FIG. 1 and FIG. 2, the cooling apparatus 100 includes a body 110 forming an external appearance of the cooling apparatus 100, storage compartments 121 and 122 to store articles, and the cooling unit 200 to cool the storage compartments 121 and 122.

A duct (not shown) is arranged in the inner space of the body 100. Air cooled by the cooling unit 200 flows through the duct. A machine room (not shown) is arranged at the lower portion of the body 110. A portion of the cooling unit 200 is installed in the machine room.

The storage compartments 121 and 122 used to store articles are provided in the body 110.

The storage compartments 121 and 122 are partitioned into left and right sections by an intermediate partition wall. The storage compartments 121 and 122 are divided into a first storage compartment 121 corresponding to a refrigeration compartment to store articles in a cool state and a second storage compartment 122 corresponding to a freezer compartment to store articles in a frozen state. The front of the first storage compartment 121 and the second storage compartment 122 is open.

In addition, the storage compartments 121 and 122 are respectively provided with storage temperature sensors 161 and 162 to sense temperatures of the storage compartments 121 and 122. Specifically, the first storage temperature sensor 161 is provided in the first storage compartment 121 to sense the temperature of the first storage compartment 121 and provide the sensed temperature of the first storage compartment 121 to a controller, which will be described later, and the second storage temperature sensor 162 is provided in the second storage compartment 122 to sense the temperature of the second storage compartment 122 and provide the sensed temperature of the second storage compartment 121 to the controller.

The storage temperature sensors 161 and 162 may employ thermistors, electrical resistance of which varies with temperature.

Doors 131 and 132 are provided to shield the first storage compartment 121 and the second storage compartment 122 having the open front against external air. The doors 131 and 132 may be provided with a display unit (not shown) to display information on operations of the cooling apparatus 100, and an input unit (not shown) to input operational commands from a user.

The cooling unit 200 includes a compressor 210, a condenser 220, a flow passage switching valve 225, expansion valves 231 and 232, and evaporators 241 and 242.

The compressor 210 is installed in the machine room (not shown) provided at the lower portion of the body 110. The compressor 210 uses rotational power of the motor, which is rotated by electrical energy supplied thereto from an external power source, to compress the low-pressure gaseous refrigerant evaporated by the evaporators 241 and 242 to high pressure and send the compressed refrigerant to the condenser 220.

When driving current is supplied from a driving unit, which will be described later, to a motor (not shown) of the compressor 210, the rotating shaft of the motor is rotated through magnetic interaction between the rotator and the stator. The rotational power produced by the motor (not shown) in this manner is converted into rectilinear movement of a piston (not shown) of the compressor 210. Then, the gaseous refrigerant may be compressed to high pressure through the rectilinear movement of the piston (not shown). In addition, by transmitting the rotational power produced by the motor (not shown) of the compressor 210 to blades connected to the rotating shaft of the motor and using a stick-slip phenomenon occurring between the blades and a vessel (not shown) of the compressor 210, the gaseous refrigerant may be compressed to high pressure.

The motor of the compressor 210 may employ an induction-type alternating current (AC) servomotor, a synchronous-type AC servomotor, and a brushless direct current (BLDC) motor, for example.

The refrigerant compressed by the compressor 210 may circulate along the condenser 220, the expansion valves 231 and 232, and the evaporators 241 and 242. That is, the compressor 210 performs the key function in the cooling unit 200 which cools the storage compartments 121 and 122. Driving of the cooling unit 200 may be viewed as driving of the compressor 210.

The condenser 220 may be installed in the machine room (not shown) provided at the lower portion of the body 110, or outside the body 110, such as, specifically, on the rear surface of the cooling apparatus 100.

The gaseous refrigerant compressed by the compressor 210 is condensed while passing through the condenser 220, thereby undergoing a phase change from gas to liquid. During condensation, the refrigerant releases latent heat to the condenser 220. The latent heat of the refrigerant refers to heat energy released to the external air when the gaseous refrigerant cooled to the boiling point undergoes phase change from gas to liquid at the same temperature. The latent heat also refers to the heat energy absorbed from the external air when the liquid refrigerant heated to the boiling point undergoes phase change to gas at the same temperature.

Due to the latent heat released by the refrigerant, the temperature of the condenser 220 rises. Accordingly, in the case that the condenser 220 is installed in the machine room (not shown), a separate heat dissipating fan 150 is provided to cool the condenser 220.

The flow passage switching valve 225 is designed to select a flow passage for the liquid refrigerant condensed by the condenser 220. To this end, the flow passage switching valve 225 may employ a three-way valve having one fluid inlet and two outlets. Hereinafter, the outlet allowing the refrigerant to flow out to the first evaporator 241 is referred to as a first refrigerant outlet 225*a*, and the outlet allowing the refrigerant to flow out to the second evaporator 242 is referred to as a second refrigerant outlet 225*b*.

The flow passage switching valve 225 allows the refrigerant to pass through the first evaporator 241 which cools the first storage compartment 121 and the second evaporator 242 which cools the second storage compartment 122, by opening the first refrigerant outlet 225*a*. The flow passage switching valve 225 allows the refrigerant to only pass through the second evaporator 242 by opening the second refrigerant outlet 225*b*. In other words, when the first storage compartment 121 needs to be cooled, the flow passage switching valve 225 opens the first refrigerant outlet 225*a* to allow the refrigerant to pass through both the first evaporator 241 and the second evaporator 242. When the second storage compartment 122 needs to be cooled, the flow passage switching valve 225 opens the second refrigerant outlet 225*b* to allow the refrigerant only to pass through the second evaporator 242. That is, regardless of whether the flow passage switching valve 225 opens the first refrigerant outlet 225*a* or the second refrigerant outlet 225*b*, the refrigerant always passes through the second evaporator 242 and therefore the second storage compartment 122 is cooled whenever the compressor 210 is driven.

Once the flow passage of the refrigerant is selected by the flow passage switching valve 225, the pressure of the refrigerant is lowered by the expansion valves 231 and 232. That is, the expansion valves 231 and 232 lower the pressure of the high-pressure liquid refrigerant to a pressure at which the refrigerant may be evaporated by throttling. Herein, throttling refers to depressurization of a fluid without heat exchange with the external air in a narrow passage such as a nozzle or an orifice through which the fluid passes.

In addition, the expansion valves 231 and 232 may regulate the amount of the refrigerant supplied to the evaporators 241 and 242 such that the refrigerant sufficiently absorbs heat in the evaporators 241 and 242. Further, opening of the expansion valves 231 and 232 and a degree thereof may be adjusted by a controller, which will be described later.

The evaporators 241 and 242 are provided at the duct (not shown) arranged in the inner space of the body 110, as described above. The evaporators 241 and 242 evaporate the low-pressure liquid refrigerant depressurized by the expansion valves 231 and 232. While being evaporated, the liquid refrigerant absorbs latent heat from the evaporators 241 and 242. The evaporators 241 and 242 are cooled by releasing heat energy to the refrigerant, and thus the air around the evaporators 241 and 242 is cooled by the cooled evaporators 241 and 242.

The low-pressure gaseous refrigerant evaporated by evaporators 241 and 242 is again supplied to the compressor 210, repeating the refrigeration cycle.

When the evaporators 241 and 242 are cooled, sublimation of the vapor around the evaporators 241 and 242 occurs. Thereby, frost may be formed on the evaporators 241 and 242, or vapor around the evaporators 241 and 242 may be condensed on the surface of the evaporators 241 and 242, forming frost on the evaporators 241 and 242. The frost formed on the evaporators 241 and 242 lowers heat exchange efficiency of the evaporators 241 and 242, resulting in relatively lower cooling efficiency of the cooling apparatus 100.

The cooling apparatus 100 is provided with a defrosting heater 250 to remove frost formed on the first evaporator 241, which cools the first storage compartment 121 functioning as a refrigeration compartment, using the first air blower 141, which will be described later, and to remove frost formed on the second evaporator 242, which cools the second storage compartment 122 functioning as a freezer compartment. The refrigeration compartment is usually maintained at a temperature above zero, and therefore frost may be removed from the evaporator for the refrigeration compartment by supplying air of the refrigeration compartment to the evaporator using an air blower. On the other hand, the freezer compartment is usually maintained at a temperature below zero, and therefore it is difficult to remove frost formed on the evaporator by supplying the air of the freezer compartment to the evaporator using an air blower.

The defrosting heater 250, which is arranged at the lower side of the second evaporator 242, produces heat through electrical resistance.

Provided at the upper side of the evaporators 241 and 242 are defrosting temperature sensors 181 and 182 to sense the temperatures of the evaporators 241 and 242. The defrosting temperature sensors 181 and 182 include a first defrosting temperature sensor 181 to sense the temperature of the first evaporator 241 and a second defrosting temperature sensor 182 to sense the temperature of the second evaporator 242. The defrosting temperature sensors 181 and 182 provide the results of sensing to a controller, which will be described later.

The air blowers 141 and 142 cause air to circulate in the duct (not shown) in the body 110 and the storage compartments 121 and 122. That is, the air blowers 141 and 142 supply the air cooled by the evaporators 241 and 242 arranged at the duct (not shown) to the storage compartments 121 and 122, and cause the air in the storage compartments 121 and 122 to be drawn into the duct (not shown) provided at the evaporators 241 and 242 to cool the air.

The air blowers 141 and 142 are arranged to respectively correspond to the first storage compartment 121 and the second storage compartment 122. The air blowers 141 and 142 include a first air blower 141 to circulate air in the duct (not shown) provided to the first storage compartment 121 and the first storage compartment 121 and a second air blower 142 to circulate air in the duct (not shown) provided to the second storage compartment 122 and the second storage compartment 122. In addition, as described above, the first air blower 141 serves to remove frost formed on the first evaporator.

In addition, the outer wall of the body 110 is provided with an external air temperature sensor 180 to sense the temperature of external air outside of the cooling apparatus 100. The external air temperature sensor 180 is installed to be spaced a predetermined distance from the ground. The external air temperature sensor 180 may be installed at the upper side of the outer wall of the cooling apparatus 100.

Figure 3:
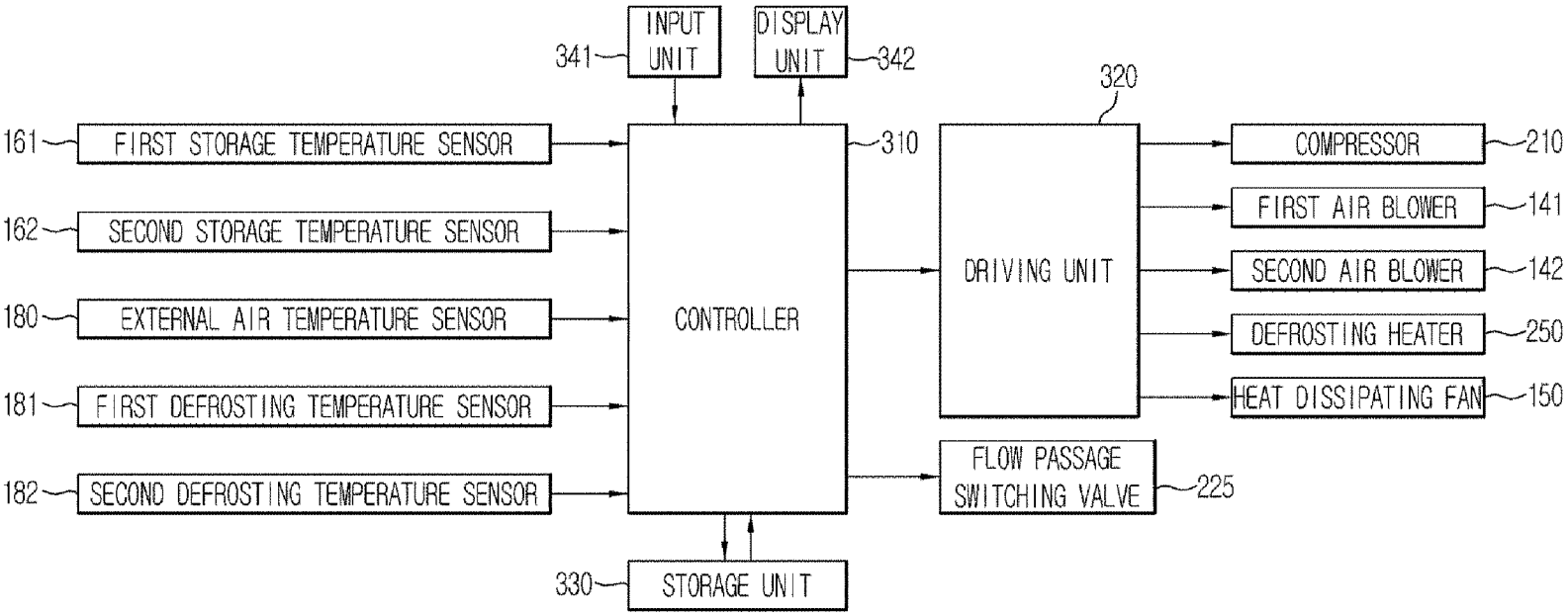
FIG. 3 is a block diagram illustrating a control procedure of the cooling apparatus according to the illustrated embodiment.

FIG. 3 is a block diagram schematically illustrating a control procedure of the cooling apparatus according to the illustrated embodiment.

For control of operation of the cooling apparatus 100 according to the illustrated embodiment, the cooling apparatus 100 includes storage temperature sensors 161 and 162, defrosting termination temperature sensors 181 and 182, an external air temperature sensor 180, a compressor 210, air blowers 141 and 142, a heat dissipating fan 150, a defrosting heater 250, an input unit 341, a display unit 342, a driving unit 320, a flow passage switching valve 225, a storage unit 330, and a controller 310. Because the storage temperature sensors 161 and 162, the defrosting temperature sensors 181 and 182, the external air temperature sensor 180, the compressor 210, the air blowers 141 and 142, the heat dissipating fan 150, and the defrosting heater 250 have been described above, a description thereof will be omitted.

The input unit 341 may employ a button switch, a membrane switch, or a touchscreen, for example. Through the input unit 341, a user inputs operational commands for the cooling apparatus 100 such as supply of power to the cooling apparatus 100, a target temperature of the first storage compartment 121, and a target temperature of the second storage compartment 122.

As the display unit 342, a liquid crystal display (LCD) panel or an organic light emitting diode (OLED) display panel may be employed. The display unit 342 displays operational information about the cooling apparatus 100 including the target temperature and current temperature of the first storage compartment 121 and the second storage compartment 122. In addition, the display unit 342 may be provided with a speaker (not shown) to announce an abnormal operation of the cooling apparatus 100 to the user.

The driving unit 320 drives the compressor 210, the air blowers 141 and 142, the heat dissipating fan 150 and the defrosting heater 250, according to control signals from the controller 310, which will be described later.

To drive compressors 210, the driving unit 320 may employ a voltage inverter. The voltage inverter includes a converter to rectify commercial AC power into DC power, a capacitor to smooth the DC link voltage, and an inverter to control the rectified DC voltage and the frequency at the same time with the control technique of pulse width modulation (PWM).

The storage unit 330 stores various kinds of information related to operation of the cooling apparatus 100. Specifically, the storage unit 330 stores therein information related to operation of the cooling apparatus 100 including execution of the first cooling operation and second cooling operation, execution of the first defrosting operation and second defrosting operation, execution of the first overload defrosting operation and second overload defrosting operation, and minimum defrosting time, defrosting termination temperature, the storage upper limit temperature, storage lower limit temperature, and storage target temperature, which will be described later. When there is a request from the controller 310, the controller 310 provides the information.

The controller 310 directs the operations of the cooling apparatus 100, and controls each constituent of the cooling apparatus 100 such that each function of the cooling apparatus 100 is efficiently performed. The operation of the controller 310 may be broadly divided into a cooling operation of cooling the storage compartments 121 and 122 and a defrosting operation of removing frost formed on the evaporators 241 and 242. That is, the controller 310 controls the driving unit 320 based on the result of sensing by the storage temperature sensors 161 and 162 to actuate the compressor 210 and the air blowers 141 and 142, and controls the flow passage switching valve 225 to evaporate the refrigerant in the evaporators 241 and 242 to cool the storage compartments 121 and 122. To maintain the cooling efficiency at a constant level, the controller 310 controls the driving unit 320 based on the result of sensing by the defrosting temperature sensors 181 and 182 to operate the defrosting heater 250 and the first air blower 141 to perform the defrosting operation of removing the frost formed on the evaporators 241 and 242.

Figure 4A:
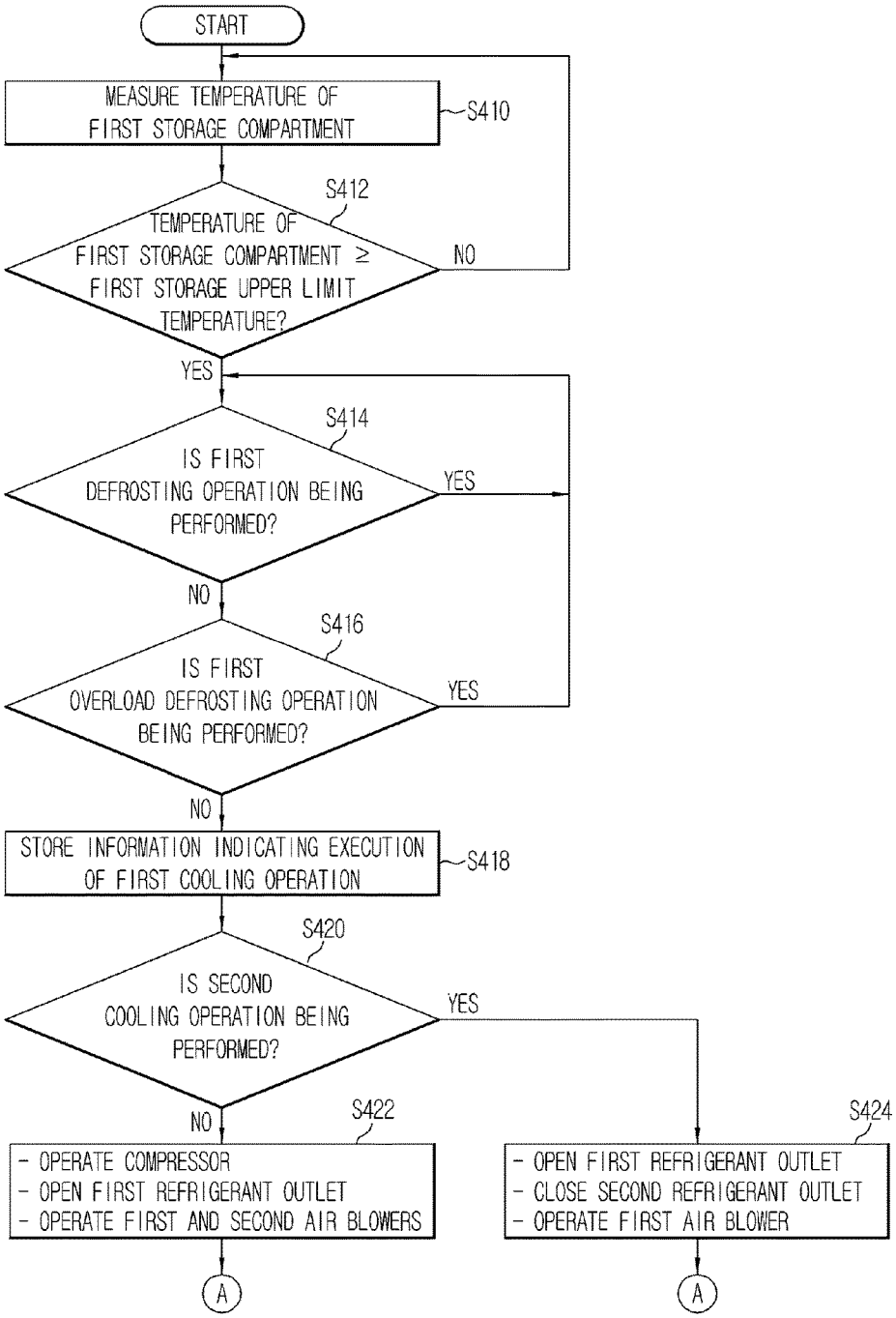
FIGS. 4A and 4B are flowcharts illustrating a method of controlling a first cooling operation of the cooling apparatus according to an embodiment of the present disclosure.
Figure 4B:
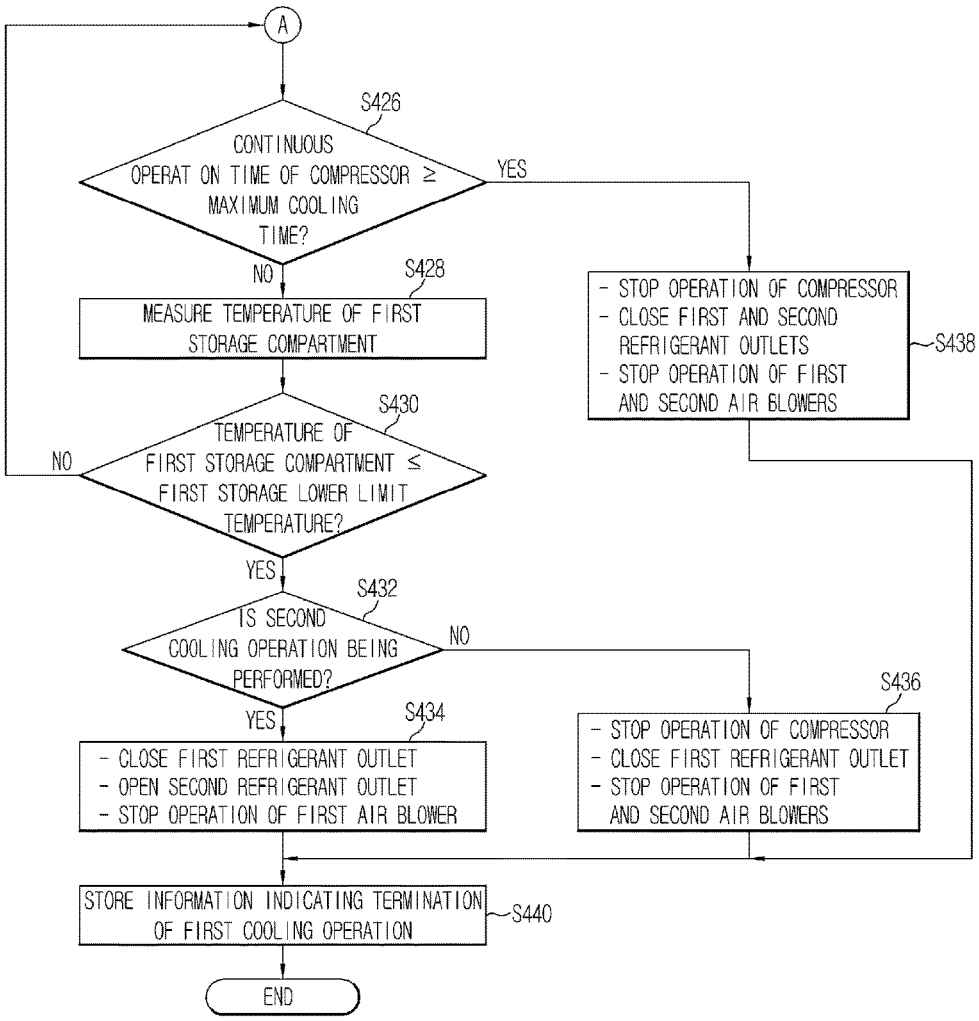
Figure 5A:
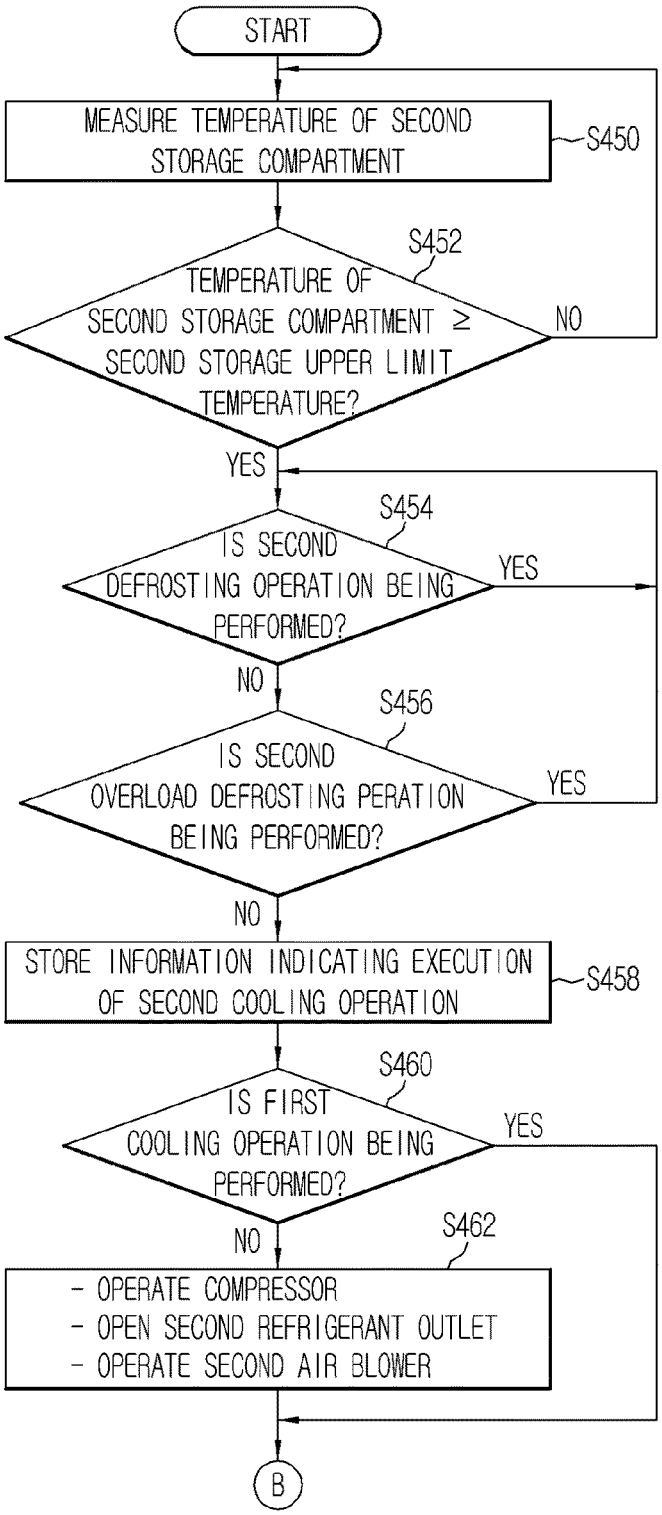
FIGS. 5A and 5B are flowcharts illustrating a method of controlling a second cooling operation of the cooling apparatus according to the illustrated embodiment.
Figure 5B:
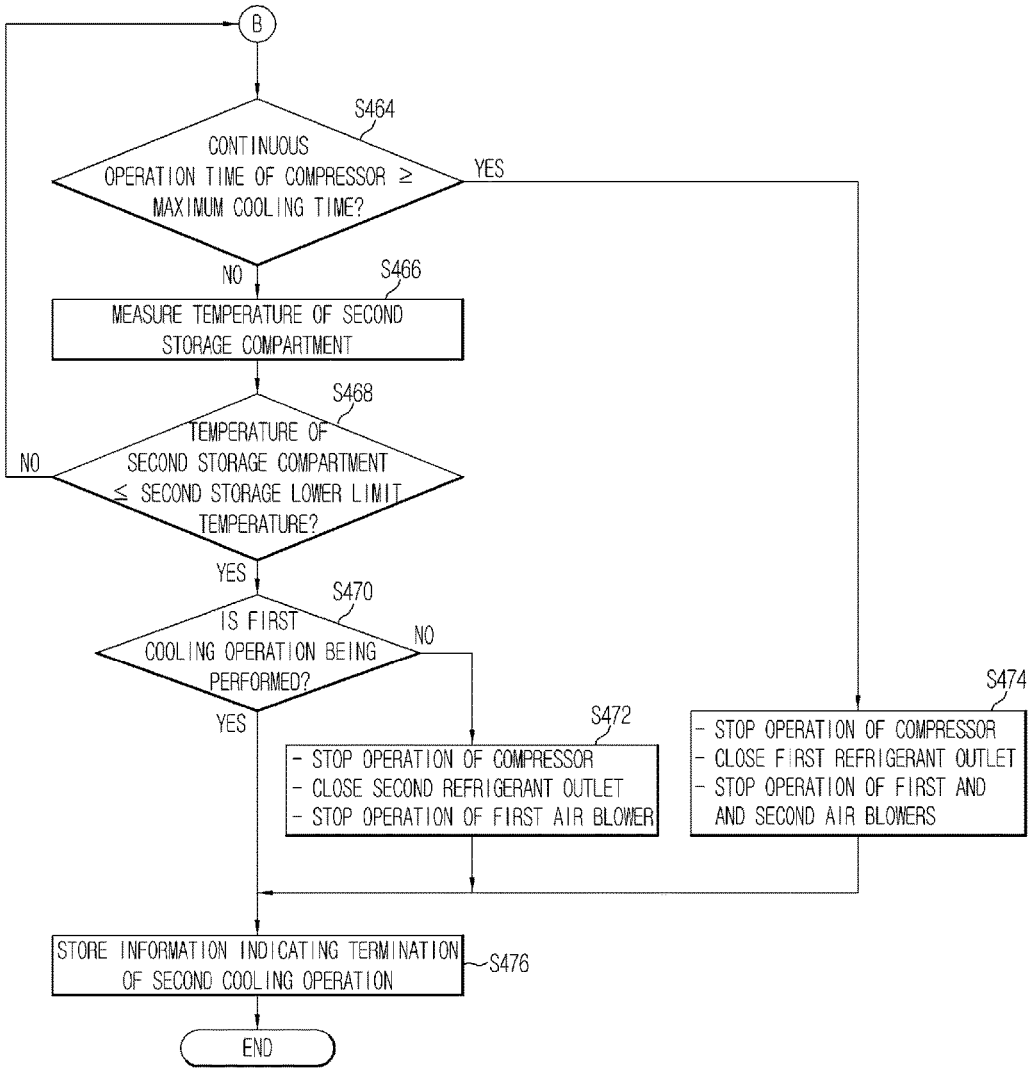

FIGS. 4A and 4B are flowcharts illustrating a method of controlling a first cooling operation of the cooling apparatus according to an embodiment of the present disclosure. FIGS. 5A and 5B are flowcharts illustrating a method of controlling a second cooling operation of the cooling apparatus according to the illustrated embodiment.

Cooling operations will be first described with reference to FIGS. 4A, 4B, 5A, and 5B. The cooling apparatus 100 measures the temperatures of the storage compartments 121 and 122 through the storage temperature sensors 161 and 162 provided to the storage compartments 121 and 122, and determines whether the temperatures of the storage compartments 121 and 122 are greater than or equal to a predetermined temperature (a storage upper limit temperature), based on the results of sensing by the storage temperature sensors 161 and 162. When the temperatures of the storage compartments 121 and 122 are greater than or equal to the storage upper limit temperature, the cooling apparatus 100 operates the compressor 210 and the air blowers 141 and 142, and controls opening of the refrigerant outlets 225*a* and 225*b* of the flow passage switching valve 225 to cool the storage compartments 121 and 122.

The cooling apparatus 100 is given a set storage target temperature at which the cooling apparatus 100 functions to store articles for a long period of time, and the initial value of the storage target temperature is set when the cooling apparatus 100 is manufactured. The storage target temperature may be changed later through manipulation of the input unit 341 by the user. For example, because the first storage compartment 121 functioning as the refrigeration compartment stores articles in a cooled state, the temperature thereof may be set to a first storage target temperature of, for example, 4° C. For the second storage compartment 122 functioning as the freezer compartment to store articles in a frozen state, the temperature thereof may be set to a second storage target temperature of, for example, −20° C.

In addition, for the cooling apparatus 100 to maintain the set storage target temperature, a storage upper limit temperature at which the cooling apparatus 100 begins the cooling operation and a storage lower limit temperature at which the cooling apparatus 100 stops the cooling operation are set. Generally, the storage upper limit temperature is set to a temperature 1° C. higher than the storage target temperature, and the storage lower limit temperature is set to a temperature 1° C. lower than the storage target temperature. According to the above example, the first storage target temperature of the first storage compartment 121 is 4° C. Accordingly, the first storage upper limit temperature is 5° C., and the first storage lower limit temperature is 3° C. Because the second storage target temperature of the second storage compartment 122 is −20° C., the second storage upper limit temperature is −19° C., and the second storage lower limit temperature is −21° C.

Specifically, the cooling apparatus 100 measures the temperature of the first storage compartment 121 through the storage temperature sensor 161 (operation S410), and compares the temperature of the first storage compartment 121 with the first storage upper limit temperature (operation S412). When the temperature of the first storage compartment 121 becomes greater than or equal to the first storage upper limit temperature, the cooling apparatus 100 performs the first cooling operation.

In the illustrated embodiment, the cooling apparatus 100 first performs the defrosting operation, which will be described later, to maintain a constant heat exchange efficiency of the evaporators 241 and 242. Accordingly, the cooling apparatus 100 determines whether the first defrosting operation or first overload defrosting operation to defrost the first evaporator 241 is being performed (operation S414, operation S416). In the case that none of the first defrosting operation and the first overload defrosting operation is being performed, the cooling apparatus 100 stores information indicating execution of the first cooling operation in the storage unit 330 (operation S418), and performs the first cooling operation.

At this time, depending on whether the second cooling operation of cooling the second storage compartment 122 is being performed (operation S420), the cooling apparatus 100 is controlled in different manners to perform the first cooling operation. That is, in the case that the second cooling operation is not being performed, the cooling apparatus 100 operates the compressor 210 and the first air blower 141 because the compressor 210 is not in operation, and opens the first refrigerant outlet 225*a* of the flow passage switching valve 225 (operation S422) to allow the refrigerant to pass through the first evaporator 241. In the case that the second cooling operation is being performed, the compressor 210 is already in operation and the second refrigerant outlet 225*b* of the flow passage switching valve 225 is in the opened state. Therefore, the cooling apparatus 100 operates the first air blower 141, opens the first refrigerant outlet 225*a* of the flow passage switching valve 225, and closes the second refrigerant outlet 225*b* of the flow passage switching valve 225 (operation S424). As described above, when the first refrigerant outlet 225*a* of the flow passage switching valve 225 is opened to cool the first storage compartment 121, the refrigerant passes not only through the first evaporator 241, but also through the second evaporator 242. Accordingly, in this case, the cooling apparatus 100 also operates the second air blower 142, and thus the second storage compartment 122 is also cooled. That is, during the first cooling operation of the cooling apparatus 100, the first storage compartment 121 and the second storage compartment 122 are both cooled.

Once the first cooling operation is performed, the cooling apparatus 100 determines whether the continuous operation time of the compressor 210 is greater than or equal to the maximum cooling time to determine whether to perform the overload defrosting operation, which will be described later (operation S426). In the case that the continuous operation time of the compressor 210 is greater than or equal to the maximum cooling time, the cooling apparatus 100 stops operation of the compressor 210, closes the first and second refrigerant outlets 225*a* and 225*b*, and stops operation of the first and second air blowers 141 and 142, to perform an overload defrosting operation (operation S438). Then, the cooling apparatus 100 stores information indicating termination of the first cooling operation in the storage unit 330 (operation S440).

In the case that the continuous operation time of the compressor 210 is less than the maximum cooling time, the cooling apparatus 100 measures the temperature of the first storage compartment 121 (operation S428), and compares the temperature of the first storage compartment 121 with the first storage lower limit temperature (operation S430). When the temperature of the first storage compartment 121 becomes less than or equal to the first storage lower limit temperature through the first cooling operation, the cooling apparatus 100 terminates the first cooling operation.

Depending on whether the second cooling operation is being performed in terminating the first cooling operation (operation S432), the cooling apparatus 100 is controlled in different manners, just as in starting the first cooling operation. Specifically, in the case that the second cooling operation is being performed, the second storage compartment 122 needs to be cooled. Therefore, the cooling apparatus 100 closes the first refrigerant outlet 225*a* of the flow passage switching valve 225, opens the second refrigerant outlet 225*b*, and stops operation of the first air blower 141, while maintaining operation of the compressor 210 (operation S434). In the case that the second cooling operation is not being performed, the second storage compartment 122 does not need be cooled. Therefore, the cooling apparatus 100 stops operation of the compressor 210, closes the first refrigerant outlet 225*a* of the flow passage switching valve 225, and stops operation of the first air blower 141 (operation S436). Thereafter, the cooling apparatus 100 stores information indicating termination of the first cooling operation in the storage unit 330 (operation S440).

According to the previously described example, when it is sensed by the first storage temperature sensor 161 that the temperature of the first storage compartment 121 becomes greater than or equal to 5° C., the cooling apparatus 100 operates the compressor 210, the first air blower 141, and the second air blower 142, and opens the first refrigerant outlet 225*a* of the flow passage switching valve 225. Thereafter, when the temperature of the first storage compartment 121 becomes less than or equal to 3° C., the cooling apparatus 100 stops operation of the compressor 210.

The second cooling operation for the second storage compartment 122 is performed in the same way. That is, the cooling apparatus 100 measures the temperature of the second storage compartment 122 through the second storage temperature sensor 162 (operation S450), and compares the temperature of the second storage compartment 122 with the second storage upper limit temperature (operation S452). When the temperature of the second storage compartment 122 becomes greater than or equal to the second storage upper limit temperature, the cooling apparatus 100 determines whether the second defrosting operation or the second overload defrosting operation is being performed (operation S454, operation S456). In the case that the second defrosting operation and the second overload defrosting operation are not being performed, the cooling apparatus 100 stores the 'second cooling operation in progress' in the storage unit 330 (operation S458), and determines whether the first cooling operation is being performed (operation S460). In the case that the first cooling operation is being performed, the second storage compartment 122 is also cooled by the first cooling operation. Therefore, the cooling apparatus 100 does not perform a separate control operation. In the case that the first cooling operation is not being performed, the cooling apparatus 100 operates the compressor 210, opens the second refrigerant outlet 225*b* of the flow passage switching valve 225, and operates the second air blower 142 (operation S462).

While the second cooling operation is being performed, the cooling apparatus 100 compares the continuous operation time of the compressor 210 with the maximum cooling time (operation S464). In the case that the continuous operation time of the compressor 210 is greater than or equal to the maximum cooling time, the cooling apparatus 100 stops operation of the compressor 210, closes the first and second refrigerant outlets 225*a* and 225*b* of the flow passage switching valve 225, and stops operation of the first and second air blowers 141 and 142 (operation S474). In addition, the cooling apparatus 100 stores 'termination of the second cooling operation' in the storage unit 330 (operation S476).

In addition, the cooling apparatus 100 determines whether the temperature of the second storage compartment 122 cooled by the second cooling operation is less than or equal to the second storage lower limit temperature (operation S466, operation S468). In the case that the temperature of the second storage compartment 122 is less than or equal to the second storage lower limit temperature, the cooling apparatus 100 terminates the second cooling operation. At this time, the cooling apparatus 100 determines whether the first cooling operation is being performed (operation S470). In the case that the first cooling operation is being performed, the cooling apparatus 100 does not perform a separate control operation. In the case that the first cooling operation is not being performed, the cooling apparatus 100 stops operation of the compressor 210, closes the second refrigerant outlet 225*b* of the flow passage switching valve 225, and stops operation of the second air blower 142 (operation S472). In addition, the cooling apparatus 100 stores 'termination of the second cooling operation' in the storage unit 330 (operation S476).

According to the example previously described, when the temperature of the second storage compartment 122 is greater than or equal to −19° C., the cooling apparatus 100 operates the compressor 210 and the second air blower 142, and opens the second refrigerant outlet 225*b* of the flow passage switching valve 225. Thereafter, when the temperature of the second storage compartment 122 becomes less than or equal to −21° C., the cooling apparatus 100 stops operation of the compressor 210.

As described above, when the temperature of the first storage compartment 121 becomes greater than or equal to the first storage upper limit temperature during the second cooling operation, the cooling apparatus 100 closes the second refrigerant outlet 225*b* of the flow passage switching valve 225, and opens the first refrigerant outlet 225*a*. Thereby, the refrigerant is allowed to pass through both the first evaporator 241 and the second evaporator 242. Accordingly, in the case that the temperature of the first storage compartment 121 becomes less than or equal to the first storage lower limit temperature before the temperature of the second storage compartment 122 becomes less than or equal to the second storage lower limit temperature, the cooling apparatus 100 closes the first refrigerant outlet 225*a* of the flow passage switching valve 225, and opens the second refrigerant outlet 225*b* to allow the refrigerant to only pass through the second evaporator 242. In the case that the temperature of the second storage compartment 122 becomes less than or equal to the second storage lower limit temperature before the temperature of the first storage compartment 121 becomes less than or equal to the first storage lower limit temperature, the cooling apparatus 100 allows the first storage compartment 121 and the second storage compartment 122 to be cooled together, without performing a separate control operation.

Figure 6A:
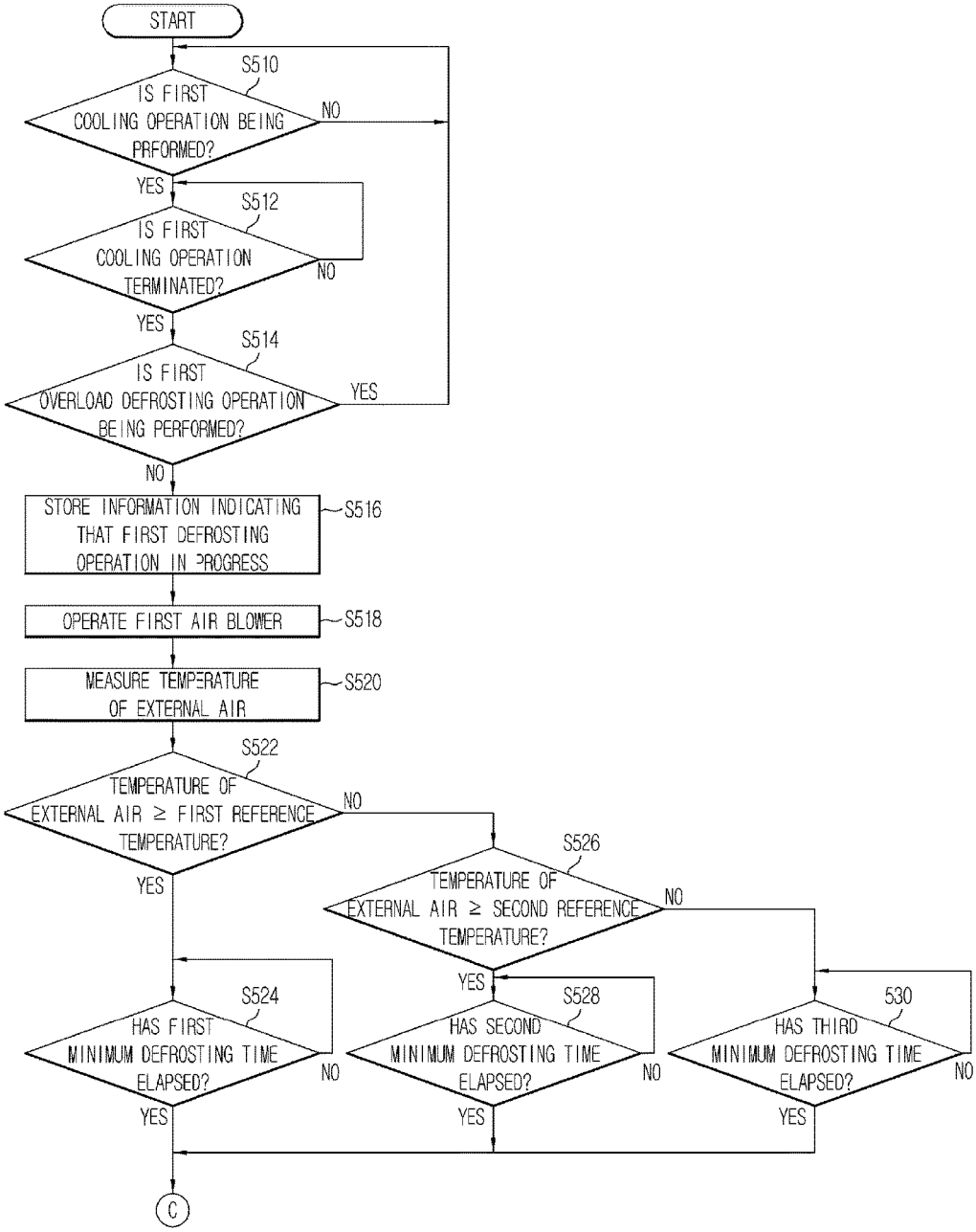
FIGS. 6A and 6B are flowcharts illustrating a method of controlling a first defrosting operation of the cooling apparatus according to the illustrated embodiment.
Figure 6B:
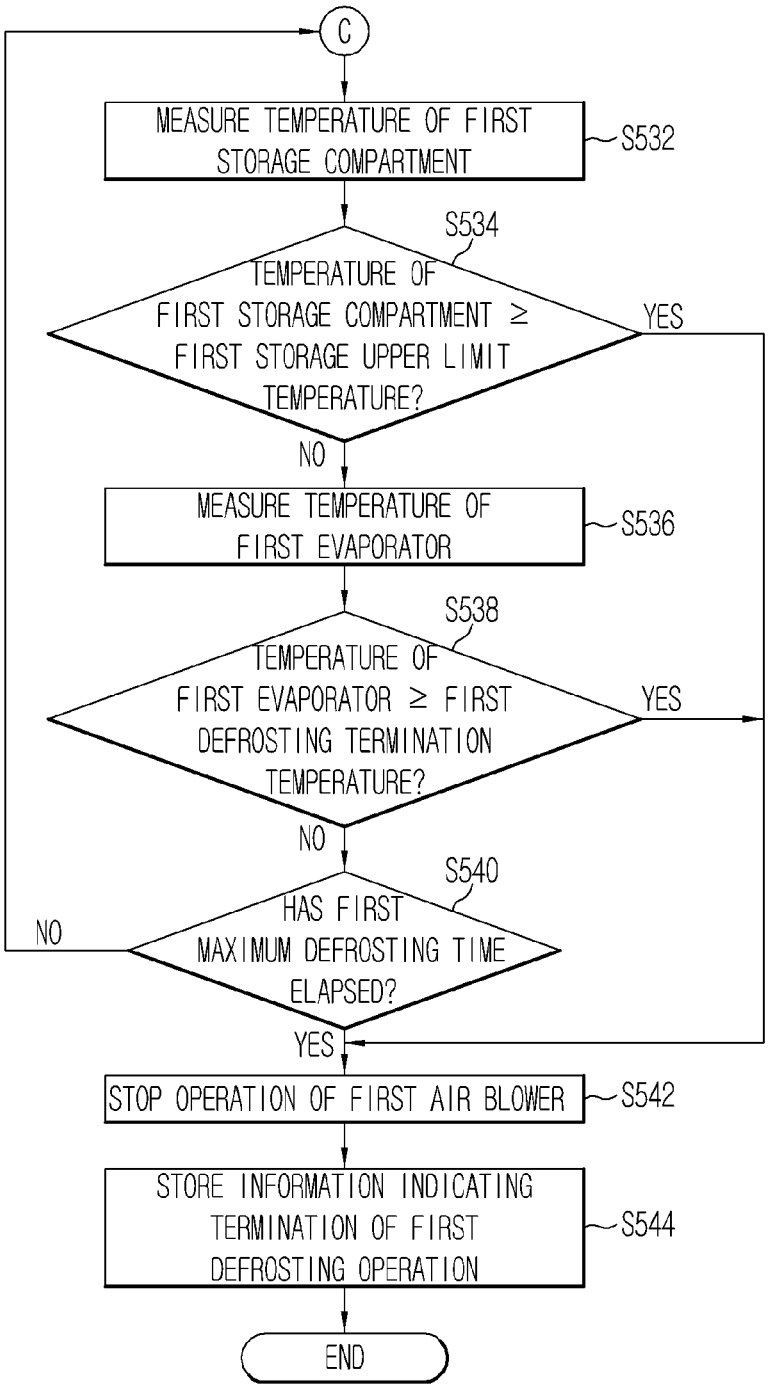
Figure 7:
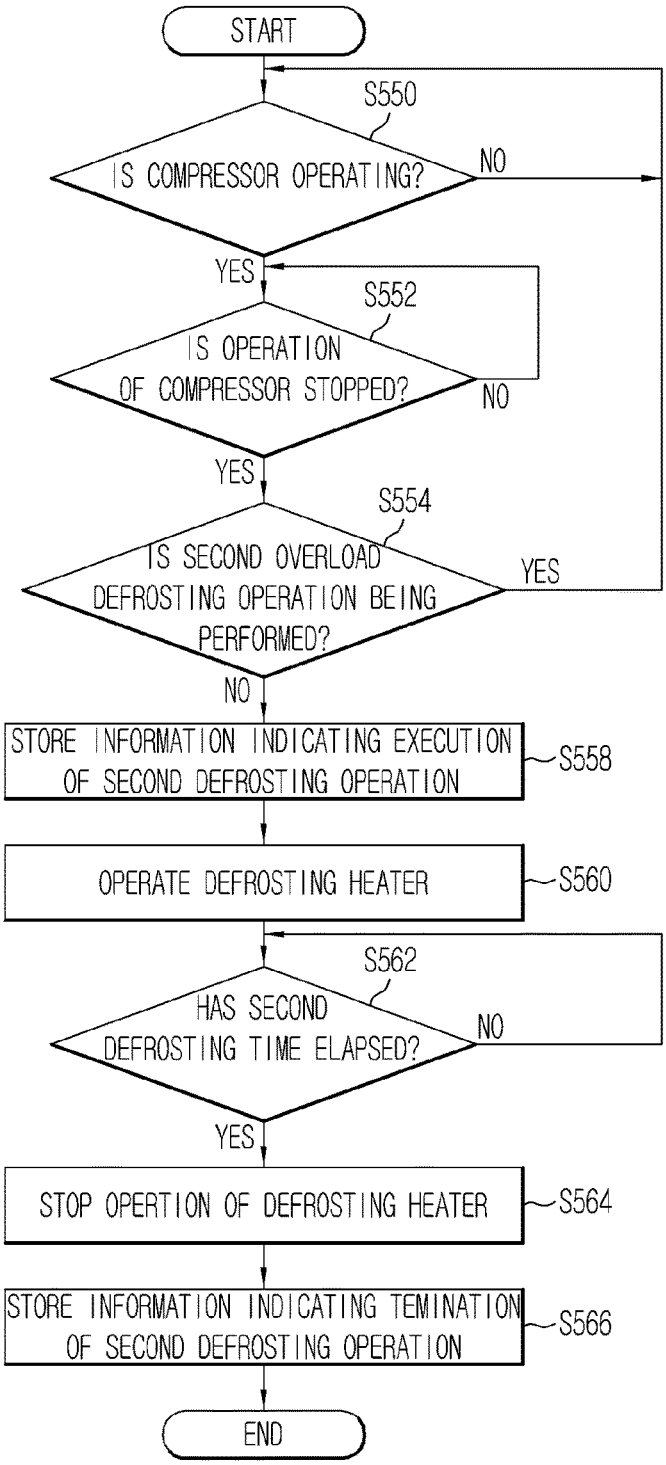
FIG. 7 is a flowchart illustrating a method of controlling a second defrosting operation of the cooling apparatus according to the illustrated embodiment.

FIGS. 6A and 6B are flowcharts illustrating a method of controlling a first defrosting operation of the cooling apparatus according to the illustrated embodiment, and FIG. 7 is a flowchart illustrating a method of controlling a the second defrosting operation of the cooling apparatus according to the illustrated embodiment. Hereinafter, the defrosting operation of removing frost formed on the evaporators 241 and 242 through the cooling operation of the cooling apparatus 100 will be described with reference to FIGS. 6A, 6B, and 7.

The operations of the cooling apparatus 100 for defrosting of the evaporators 241 and 242 are performed as follows. The cooling apparatus 100 performs a first defrosting operation of removing frost formed on the first evaporator 241 and the second defrosting operation of removing frost formed on the second evaporator 242. In other words, the cooling apparatus 100 stops operation of the compressor 210 or closes the first refrigerant outlet 225*a* of the flow passage switching valve 225 (because the first defrosting operation and the second cooling operation may be performed together, operation of the compressor 210 is maintained in the case that the second cooling operation is being performed, but is stopped in the case that the second cooling operation is not being performed) such that the refrigerant is not supplied to the first evaporator 241. In this state, the first air blower 141 is operated to perform the first defrosting operation. In addition, while operation of the compressor 210 is stopped such that the refrigerant is not supplied to the second evaporator 242, the cooling apparatus 100 stops operation of the second air blower 142 and operates the defrosting heater 250 to perform the second defrosting operation.

The process from the start of the cooling operation to termination of the cooling operation is generally referred to as a cooling cycle. It generally takes a few minutes to a few dozens of minutes for the cooling apparatus to complete one cooling cycle. When the temperatures of the storage compartments 121 and 122 becomes less than or equal to the storage lower limit temperatures by performing the cooling operation, and the cooling cycle is completed, the cooling apparatus 100 performs the defrosting operation. When one cooling cycle is completed, it is highly possible that frost is formed on the evaporator 241 due to the lowered temperature of the evaporator 241, and further it is expected that the cooling operation may not be performed for some time due to the temperatures of the storage compartments 121 and 122 less than or equal to the storage lower limit temperatures.

Specifically, when the first cooling operation of cooling the first storage compartment 121 is terminated, the cooling apparatus 100 performs the first defrosting operation of removing frost formed on the first evaporator 241. When the second cooling operation of cooling the second storage compartment 122 is terminated, the second defrosting operation of removing frost formed on the second evaporator 242 should be performed. As described above, however, the refrigerant passes through both the first evaporator 241 and the second evaporator 242 during the first cooling operation. Accordingly, the refrigerant passes through the second evaporator 242 during both the first cooling operation and the second cooling operation. Therefore, the second defrosting operation is performed after the operation of the compressor 210 is stopped.

The cooling apparatus 100 uses the first air blower 141 to remove frost formed on the first evaporator 241 arranged at the first storage compartment 121 functioning as the refrigeration compartment.

The first defrosting operation using the first air blower 141 is relatively slowly performed. Thereby, the temperature of the first storage compartment 121 may become greater than or equal to the first storage upper limit temperature during the first defrosting operation, and thus the first cooling operation may need to be performed. In the case that the first defrosting operation is stopped to perform the first cooling operation according to need to perform the first cooling operation during the first defrosting operation, frost formed on the first evaporator 241 may not be sufficiently removed and thus the cooling efficiency may be lowered.

Accordingly, when the first cooling operation is performed after termination of the first defrosting operation, the cooling apparatus 100 performs the first cooling operation for the minimum defrosting time. In other words, once the first defrosting operation begins after termination of the first cooling operation, the cooling apparatus 100 does not perform the first cooling operation even if the temperature of the first storage compartment 121 is greater than or equal to the first storage upper limit temperature until the minimum defrosting time elapses after the first defrosting operation begins. In the case that the temperature of the external air is high, the temperature of the first storage compartment 121 may excessively increase. Therefore, the cooling apparatus 100 varies the minimum defrosting time according to the temperature of the external air.

Specifically, when the first cooling operation is terminated (operation S510, operation S512), the cooling apparatus 100 determines whether the first overload defrosting operation is being performed (operation S514). Because the first overload defrosting operation is also an operation to remove frost formed on the first evaporator 241, the cooling apparatus 100 does not perform the first defrosting operation.

In the case that the first overload defrosting operation is not being performed, the cooling apparatus 100 stores, in the storage unit 330, information indicating that the first defrosting operation is in progress (operation S516), and operates the first air blower 141 (operation S518) to perform the first defrosting operation.

As described above, how long the first defrosting operation will be performed depends on the temperature of the external air. Accordingly, once the first defrosting operation begins, the cooling apparatus 100 measures the temperature of the external air through the external air temperature sensor 180 (operation S520).

Then, the cooling apparatus 100 compares the temperature of the external air with a first reference temperature (operation S522). In the case that the temperature of the external air is greater than or equal to the first reference temperature, the cooling apparatus 100 performs the first defrosting operation for a time greater than or equal to a first minimum defrosting time (operation S524). In the case that the temperature of the external air is lower than the first reference temperature, the cooling apparatus 100 compares the temperature of the external air with a second reference temperature (operation S526). In the case that the temperature of the external air is greater than or equal to the second reference temperature, the cooling apparatus 100 performs the first defrosting operation for a time greater than or equal to a second minimum defrosting time (operation S528). In addition, in the case that the temperature of the external air is lower than the second reference temperature, the cooling apparatus 100 performs the first defrosting operation for a time greater than or equal to a third minimum defrosting time (operation S530).

For example, assume that the first reference temperature and the second reference temperature are respectively 28° C. and 16° C., and the first minimum defrosting time, the second minimum defrosting time, and the third minimum defrosting time are respectively 40 minutes, 60 minutes, and 90 minutes. In the case that the temperature of the external air is greater than or equal to 28° C., the cooling apparatus 100 operates the first air blower 141 to perform the first defrosting operation for at least 40 minutes after termination of the first cooling operation, not allowing the refrigerant to pass through the first evaporator 241. In the case that 40 minutes has not elapsed since the beginning of the first defrosting operation, the cooling apparatus 100 does not perform the first cooling operation, but keeps performing the first defrosting operation even if the temperature of the first storage compartment 121 becomes greater than or equal to the first storage upper limit temperature. In addition, in the case that the temperature of the external air is lower than 28° C. and greater than or equal to 16° C., the cooling apparatus 100 performs the first defrosting operation for at least 60 minutes. In the case that the temperature of the external air is lower than 16° C., the cooling apparatus 100 performs the first defrosting operation for at least 90 minutes.

As described above, in the case that the first cooling operation needs to be performed as the temperature of the first storage compartment 121 becomes greater than or equal to the first storage upper limit temperature when the minimum defrosting time has elapsed since the first defrosting operation began, the cooling apparatus 100 terminates the first defrosting operation and performs the first cooling operation. However, in the case that the first cooling operation does not need to be performed, i.e., in the case that the temperature of the first storage compartment 121 is lower than the first storage upper limit temperature even when the minimum defrosting time has elapsed since the first defrosting operation began, the cooling apparatus 100 needs to sufficiently perform the first defrosting operation.

For this reason, when the minimum defrosting time elapses after the first defrosting operation begins, the cooling apparatus 100 measures the temperature of the first storage compartment 121 (operation S532), and compares the temperature of the first storage compartment 121 with the first storage upper limit temperature (operation S534). In the case that the temperature of the first storage compartment 121 is greater than or equal to the first storage upper limit temperature, the cooling apparatus 100 stops operation of the first air blower 141 (operation S542), store 'termination of the first defrosting operation' in the storage unit 330 (operation S544), and then terminates the first defrosting operation.

If the temperature of the first storage compartment 121 is lower than the first storage upper limit temperature, the cooling apparatus 100 performs the first defrosting operation until the temperature of the first evaporator 241 reaches the predetermined temperature (the defrosting termination temperature). Specifically, the cooling apparatus 100 measures the temperature of the first evaporator 241 through the first defrosting temperature sensor 181 (operation S536), and compares the temperature of the first evaporator 241 with the defrosting termination temperature (operation S538). In the case that the temperature of the first evaporator 241 is greater than or equal to the defrosting termination temperature, the cooling apparatus 100 stops operation of the first air blower 141 (operation S542), stores information indicating termination of the first defrosting operation in the storage unit 330 in the storage unit 330 (operation S544), and then terminates the first defrosting operation. In the case that the temperature of the first evaporator 241 is lower than the defrosting termination temperature, the cooling apparatus 100 keeps performing the first defrosting operation.

Herein, the defrosting termination temperature may be set to a different temperature depending on the condition of the cooling apparatus 100 or the operational environment. For example, in the case that the defrosting termination temperature is set to 5° C. and the temperature of the external air is 25° C., the cooling apparatus 100 does not operate the compressor 210 or controls the flow passage switching valve 225 such that the refrigerant does not pass through the first evaporator 241, and operates the first air blower 141 to perform the first defrosting operation for at least 60 minutes. In the case that the temperature of the first storage compartment 121 is still lower than 5° C. when 60 minutes has elapsed since the first defrosting operation began, the cooling apparatus 100 keeps performing the first defrosting operation until the temperature of the first storage compartment 121 reaches 5° C. or the temperature of the first evaporator 241 reaches 5° C.

To sum up, in the case that the temperature of the external air is greater than or equal to 28° C., the cooling apparatus 100 performs the first defrosting operation for at least 40 minutes. When the temperature of the first evaporator 241 reaches 5° C., the cooling apparatus 100 terminates the first defrosting operation. In the case that the temperature of the external air is lower than 28° C. and greater than or equal to 16° C., the cooling apparatus 100 performs the first defrosting operation for at least 60 minutes. When the temperature of the first evaporator 241 reaches 5° C., the cooling apparatus 100 terminates the first defrosting operation. In the case that the temperature of the external air is lower than 16° C., the cooling apparatus 100 performs the first defrosting operation for at least 90 minutes. When the temperature of the first evaporator 241 reaches 5° C., the cooling apparatus 100 terminates the first defrosting operation.

In the case that the temperature of the external air is excessively lower and thus the first storage compartment 121 and the temperature of the first evaporator 241 fail to respectively reach the first storage upper limit temperature and the defrosting termination temperature, the first defrosting operation may be performed for an excessively long time. That is, unlike the second defrosting operation which is performed using the first air blower 141, in the case of the first defrosting operation which is performed using the defrosting heater 250, the temperature of the first evaporator 241 varies over a wide range depending on the temperature of the first storage compartment 121, which is greatly influenced by the temperature of the external air. Accordingly, in the case that the temperature of the external air is lower than the defrosting termination temperature at which the first defrosting operation is terminated, the temperature of the first evaporator 241 hardly rises over the defrosting termination temperature, even if the first defrosting operation is performed.

For this reason, the cooling apparatus 100 obtains a first maximum defrosting time and compares the time for which the first defrosting operation has been performed with the first maximum defrosting time (operation S540). In the case that the first defrosting operation has been performed for at least the first maximum defrosting time, the cooling apparatus 100 stops operation of the first air blower (operation S542), stores 'termination of the first defrosting operation' in the storage unit 330 (operation S544), and then terminates the first defrosting operation. Herein, the first maximum defrosting time may be set to 400 minutes. That is, even if the temperature of the first evaporator 241 does not become greater than or equal to the defrosting termination temperature after the first defrosting operation begins, the cooling apparatus 100 may terminate the first defrosting operation once 400 minutes has elapsed since the beginning of the first defrosting operation. Once the first defrosting operation is terminated, the cooling apparatus 100 stores 'termination of the first defrosting operation' in the storage unit 330 (operation S544).

Hereinafter, the second defrosting operation of removing frost formed on the second evaporator 242 will be described.

The second defrosting operation of the cooling apparatus 100 is performed using the defrosting heater 250. In other words, the cooling apparatus 100 operates the compressor 210 to perform the second cooling operation or the first cooling operation (operation S550). Then, when the operation of the compressor 210 is stopped (operation S552), the cooling apparatus 100 determines whether the second overload defrosting operation is being performed (operation S554). In the case that the second overload defrosting operation is not being performed, the cooling apparatus 100 may store 'execution of the second defrosting operation' in the storage unit 330 (operation S558), and operates the defrosting heater 250 (operation S560) to perform the second defrosting operation.

Because the second defrosting operation is performed using the defrosting heater 250, frost formed on the second evaporator 242 may be quickly removed. Therefore, when the second maximum defrosting time has elapsed since beginning of the second defrosting operation (operation S562), the second defrosting operation may be terminated. That is, when the second defrosting time has elapsed since beginning of the second defrosting operation, the cooling apparatus 100 stops operation of the defrosting heater 250 (operation S564), and stores information on 'termination of the second defrosting operation' in the storage unit 330 (operation S566). The second defrosting time, which may vary depending on the defrosting efficiency of the defrosting heater 250 or the temperature of the second evaporator 242, is generally set to approximately 10 minutes. That is, when approximately 10 minutes has elapsed since the beginning of the second defrosting operation, the cooling apparatus 100 may stop operation of the defrosting heater 250 (operation S564), store the information indicating termination of the second defrosting operation in the storage unit 330 (operation S566), and then terminate the second defrosting operation.

In the illustrated embodiment, the cooling apparatus 100 determines whether to terminate the second defrosting operation performed using the defrosting heater 250, based on the time for which the second defrosting operation has been performed. However, embodiments of the present disclosure are not limited thereto.

The cooling apparatus 100 may determine whether to terminate the second defrosting operation based on the temperature of the second evaporator 242. Specifically, after performing the second defrosting operation, the cooling apparatus 100 may stop operation of the defrosting heater 250 when the temperature of the second evaporator 242 becomes greater than or equal to the second defrosting termination temperature, based on the result of sensing by the second defrosting temperature sensor 181 which senses the temperature of the second evaporator 242. Herein, the second defrosting termination temperature may vary depending on the temperature of the second storage compartment 121. For example, considering that the melting point of ice is 0° C., the second defrosting termination temperature may be set to 2° C. That is, when the temperature of the second evaporator 242 reaches 2° C. after the cooling apparatus 100 performs the second defrosting operation, the cooling apparatus 100 may stop operation of the defrosting heater 250 to terminate the second defrosting operation.

Figure 8:
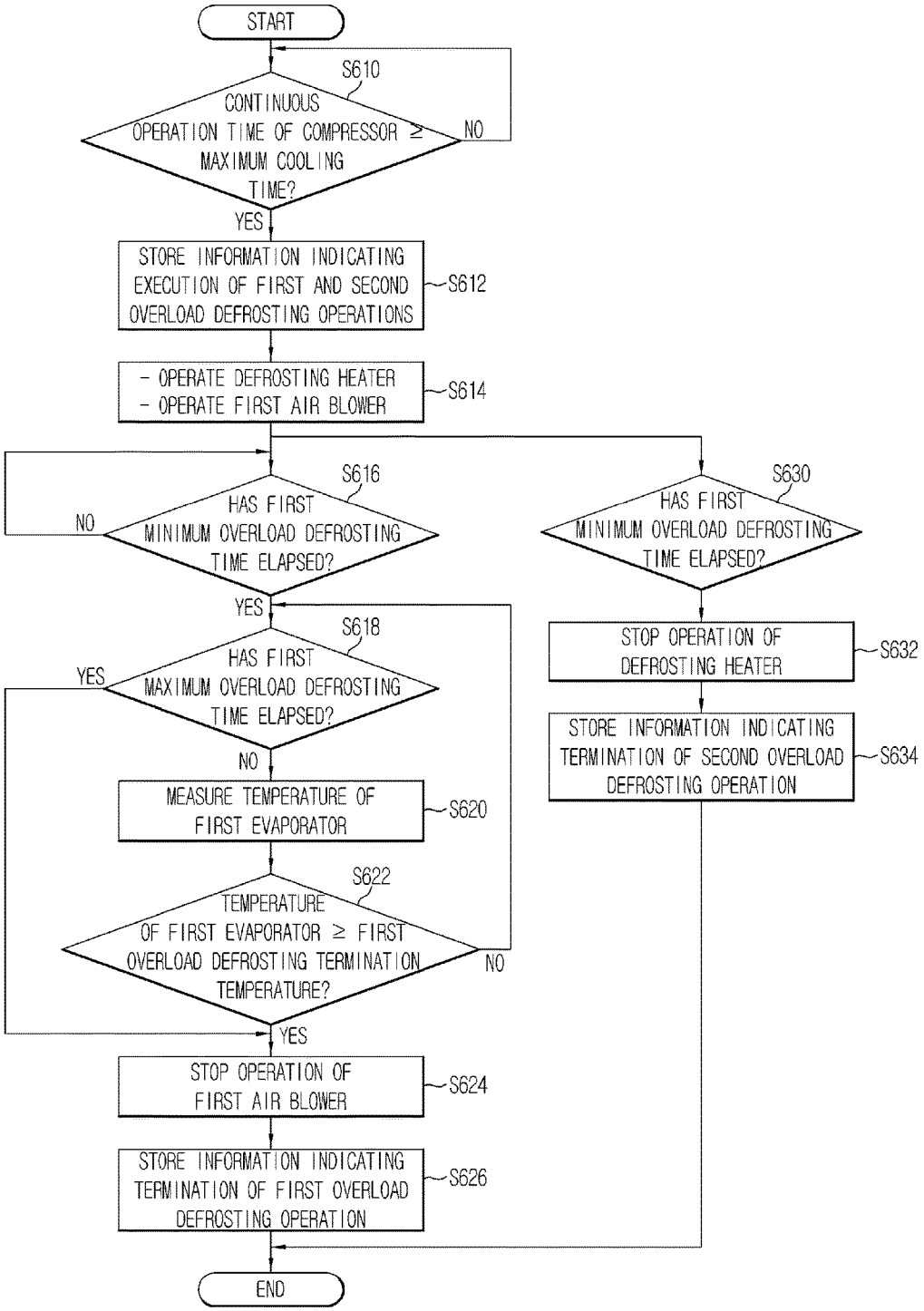
FIG. 8 is a flowchart illustrating a method of controlling an overload defrosting operation of the cooling apparatus according to the illustrated embodiment.

FIG. 8 is a flowchart illustrating a method of controlling an overload defrosting operation of the cooling apparatus according to the illustrated embodiment. In the case that electric power is applied to the cooling apparatus 100 for the first time or the doors 131 and 132 of the cooling apparatus 100 are open, the cooling apparatus 100 performs the cooling operation for a long time. In the case that the cooling operation lasts for an excessively long time, the cooling apparatus 100 performs the overload defrosting operation.

In the case that electric power is applied to the cooling apparatus 100 for the first time or the doors 131 and 132 of the cooling apparatus 100 are open, the cooling apparatus 100 continuously operates the compressor 210 to cool the storage compartments 121 and 122. It may take dozens of minutes to a few hours to cause the temperatures of the storage compartments 121 and 122 to reach the storage target temperatures by applying electric power to the cooling apparatus 100 for the first time and performing the cooling operation.

However, according to an experiment, in the case that the storage compartment is cooled by continuously performing the cooling operation, the heat exchange efficiency of the evaporators is maintained at a predetermined level for the first one hour. However, when two or more hours elapse after the cooling device begins to operate, the heat exchange efficiency of the evaporators rapidly drops. For this reason, after the cooling apparatus 100 performs the cooling operation for the maximum cooling time to cool the storage compartments 121 and 122, the cooling apparatus 100 performs the overload defrosting operation to remove frost formed on the evaporators 241 and 242. In addition, to maintain the heat exchange efficiency of evaporators 241 and 242 at a predetermined level, the maximum cooling time may be set to 60 minutes.

As described above, in the case of the cooling apparatus 100 of the illustrated embodiment, the refrigerant may be allowed only to pass through the second evaporator 242. However, when the refrigerant passes through the first evaporator 241, it also passes through the second evaporator 242. That is, when the first cooling operation is performed, the refrigerant passes through the first evaporator 241 and the second evaporator 242. In contrast, when the second cooling operation is performed, the refrigerant only passes through the second evaporator 242. Accordingly, when the compressor 210 is operated, the refrigerant is always allowed to pass through the second evaporator 242. Therefore, the continuous operation time of the compressor 210 is compared with the maximum cooling time (operation S610), and in the case that the compressor 210 has been continuously operated for at least the maximum cooling time or more time, the cooling apparatus 100 performs the second overload defrosting operation because the second storage compartment 122 has been cooled for at least the maximum cooling time.

In addition, the cooling apparatus 100 may cool only the second storage compartment 122, it may not be possible for the cooling apparatus 100 to cool only the first storage compartment 121. That is, it may be impossible for the cooling apparatus 100 to remove frost formed on the second evaporator 242 while cooling the first storage compartment 121. Accordingly, when the second overload defrosting operation of removing frost formed on the second evaporator 242 is performed, the first overload defrosting operation of removing frost formed on the first evaporator 241 may also be performed. Therefore, when the compressor 210 has been continuously operated for at least the maximum cooling time (operation S610), the cooling apparatus 100 stores information indicating execution of the first and second overload defrosting operations (operation S612), and operates the first air blower 141 and the defrosting heater 250 (operation S614) to perform the first and second overload defrosting operation.

In the case that electric power is applied to the cooling apparatus 100 for the first time or the doors 131 and 132 of the cooling apparatus 100 are open, the cooling operation may be performed immediately after the defrosting operation is terminated. It is important to maintain the cooling efficiency at a constant level during the cooling operation by sufficiently performing the defrosting operation. Therefore, the cooling apparatus 100 performs the defrosting operation, considering the defrosting time and the temperatures of the evaporators 241 and 242, but not considering the temperatures of the storage compartments 121 and 122.

Contrary to the second overload defrosting operation performed using the defrosting heater 250, the first overload defrosting operation performed using the first air blower 141 may not be quickly performed to remove frost formed on the first evaporator 241, as described above. Therefore, the first overload defrosting operation is performed to sufficiently remove frost from the first evaporator 241.

Specifically, the cooling apparatus 100 performs the first overload defrosting operation for a minimum overload defrosting time, regardless of the temperature of the first storage compartment 121 and the temperature of the first evaporator 241. Thereafter, when the minimum overload defrosting time elapses (operation S616), the cooling apparatus 100 performs the first defrosting operation within a maximum overload defrosting time until the temperature of the first evaporator 241 reaches a first overload defrosting termination temperature. That is, the cooling apparatus 100 ensures sufficient defrosting time such that the first defrosting operation is performed for the minimum overload defrosting time. The cooling apparatus 100 performs the first defrosting operation until the temperature of the first evaporator 241 becomes greater than or equal to the first overload defrosting termination temperature, such that frost formed on the first evaporator 241 is sufficiently removed. In the case that the temperature of the first evaporator 241 becomes greater than or equal to the first overload defrosting termination temperature before the minimum overload defrosting time elapses, the first defrosting operation is terminated immediately after the minimum overload defrosting time elapses. In the case that the defrosting operation is performed for an excessively long time, the main function of the cooling apparatus 100 may be undermined. Therefore, when a first maximum overload defrosting time elapses, the first defrosting operation is stopped.

Specifically, the cooling apparatus 100 determines whether a first overload defrosting time has reached or exceeded the minimum overload defrosting time (operation S618), measures the temperature of the first evaporator 241 (operation S620), and then determines whether the temperature of the first evaporator 241 is greater than or equal to the first overload defrosting termination temperature (operation S622). In the case that the minimum overload defrosting time has elapsed or the temperature of the first evaporator 241 is greater than or equal to the first overload defrosting termination temperature, the cooling apparatus 100 stops operation of the first air blower 141 (operation S624), stores information indicating termination of the first overload defrosting operation in the storage unit 330 (operation S626), and then terminates the first overload defrosting operation.

The minimum overload defrosting time, the first overload defrosting termination temperature and the maximum overload defrosting time may vary depending on the temperature of the first storage compartment 121 and humidity. For example, in the case that the minimum overload defrosting time is 20 minutes, the first overload defrosting termination temperature is 2° C., and the maximum overload defrosting time is 40 minutes, the cooling apparatus 100 performs the first overload defrosting operation for at least 20 minutes to remove frost formed on the first evaporator 241, and performs the first overload defrosting operation within 40 minutes until the temperature of the first evaporator 241 reaches 2° C. Specifically, once the cooling unit 200 is operated for 60 minutes, the cooling apparatus 100 stops operation of the compressor 210 or closes the first refrigerant outlet 225*a* of the flow passage switching valve 225 such that the refrigerant does not pass through the first evaporator 241. Thereafter, the cooling apparatus 100 operates the first air blower 141, performing the first overload defrosting operation for at least 20 minutes. In the case that 40 minutes has elapsed since beginning of the first overload defrosting operation or the temperature of the first evaporator 241 becomes greater than or equal to 2° C., the cooling apparatus 100 stops operation of the first air blower 141 to terminate the first overload defrosting operation.

In the case of the second overload defrosting operation performed using the defrosting heater 250, it may be possible to quickly remove frost formed on the second evaporator 242. Therefore, the cooling apparatus 100 performs the second overload defrosting operation for a second overload defrosting time. Specifically, the cooling apparatus 100 compares the time for which the second overload defrosting operation is performed with the second overload defrosting time (operation S630). In the case that the time for which the second overload defrosting operation is performed reaches or exceeds the second overload defrosting time, the cooling apparatus 100 stops operation of the defrosting heater 250 (operation S632), stores information indicating termination of the second overload defrosting operation in the storage unit 330 (operation S634), and then terminates the second overload defrosting operation. Herein, the second overload defrosting time may be set to 10 minutes. However, embodiments of the present disclosure are not limited thereto. The second overload defrosting operation may be terminated when the temperature of the second evaporator 242 becomes greater than or equal to a second overload defrosting termination temperature which is set to 2° C.

While the second overload defrosting operation performs the defrosting operation using the defrosting heater 250, the first overload defrosting operation performs the defrosting operation using the first air blower 141. Therefore, the second overload defrosting operation is usually terminated before the first overload defrosting operation is terminated. Once the second overload defrosting operation is first terminated, the cooling apparatus 100 operates the compressor 210, closes the first refrigerant outlet 225*a* of the flow passage switching valve 225, opens the second refrigerant outlet 225*b*, and then operates the second air blower 142 to cool the second storage compartment 122. Thereafter, when the first overload defrosting operation is terminated, the cooling apparatus 100 closes the second refrigerant outlet 225*b* of the flow passage switching valve 225, opens the first refrigerant outlet 225*a*, and operates the first air blower 141 to cool both the first storage compartment 121 and the second storage compartment 122.

In the case that the first overload defrosting operation is performed for a longer time than the second overload defrosting operation, and the compressor 210 is operated for at least the maximum cooling time, as described above, both the first overload defrosting operation and the second overload defrosting operation are performed. Therefore, in the case that electric power is supplied to the cooling apparatus 100 for the first time, the time for which the second cooling operation is performed may be shorter than the time for which the second cooling operation is performed.

As is apparent from the above description, a cooling apparatus according to an embodiment of the present disclosure may properly defrost evaporators with reduced power consumption for defrosting operation, by changing the operation time of the air blowers according to temperature of the external air outside the cooling apparatus.

The above-described embodiments may be recorded in computer-readable media including program instructions to implement various operations embodied by a computer. The media may also include, alone or in combination with the program instructions, data files, data structures, and the like. The program instructions recorded on the media may be those specially designed and constructed for the purposes of embodiments, or they may be of the kind well-known and available to those having skill in the computer software arts. Examples of computer-readable media include magnetic media such as hard disks, floppy disks, and magnetic tape; optical media such as CD ROM disks and DVDs; magneto-optical media such as optical disks; and hardware devices that are specially configured to store and perform program instructions, such as read-only memory (ROM), random access memory (RAM), flash memory, and the like. The computer-readable media may also be a distributed network, so that the program instructions are stored and executed in a distributed fashion. The program instructions may be executed by one or more processors. The computer-readable media may also be embodied in at least one application specific integrated circuit (ASIC) or Field Programmable Gate Array (FPGA), which executes (processes like a processor) program instructions. Examples of program instructions include both machine code, such as produced by a compiler, and files containing higher level code that may be executed by the computer using an interpreter. The above-described devices may be configured to act as one or more software modules in order to perform the operations of the above-described embodiments, or vice versa.

Although a few embodiments of the present disclosure have been shown and described, it would be appreciated by those skilled in the art that changes may be made in these embodiments without departing from the principles of the invention, the scope of which is defined in the claims and their equivalents.

What is claimed is:

1. A cooling apparatus comprising:

a storage compartment to store articles in a cooled state;

an evaporator to cool air in the storage compartment by evaporating a refrigerant;

a compressor to compress the evaporated refrigerant;

an air blower to supply the cooled air to the storage compartment;

a storage temperature sensor to sense a temperature of the storage compartment; and a controller to perform a cooling operation of operating the compressor and the air blower to cool the storage compartment when the temperature of the storage compartment is above an upper limit temperature, and to perform a defrosting operation of operating the air blower to remove frost formed on the evaporator when the cooling operation is terminated, wherein the defrosting operation is performed for a minimum defrosting time or more, and the cooling operation is prevented when a defrosting time for which the defrosting operation is performed is less than the minimum defrosting time, when the temperature of the storage compartment is above the upper limit temperature after the minimum defrost time has elapsed since the defrosting operation is performed, the controller terminates the defrosting operation and performs the cooling operation, and when the temperature of the storage compartment is below the upper limit temperature after the minimum defrost time has elapsed since the defrosting operation is performed, the controller continues the defrosting operation.

2. The cooling apparatus according to claim 1, further comprising an external air temperature sensor to sense a temperature of external air outside of the storage compartment, wherein the minimum defrosting time is changed according to the sensed temperature of the external air.

3. The cooling apparatus according to claim 2, wherein the minimum defrosting time decreases when the temperature of the external air increases.

4. The cooling apparatus according to claim 1, wherein the controller terminates the cooling operation and performs the defrosting operation when the temperature of the storage compartment is below a lower limit temperature.

5. The cooling apparatus according to claim 1, further comprising a defrosting temperature sensor to sense a temperature of the evaporator, wherein the controller terminates the defrosting operation when the sensed evaporator temperature is above a defrosting termination temperature and the defrosting time is greater than or equal to the minimum defrosting time.

6. The cooling apparatus according to claim 1, wherein the controller terminates the defrosting operation when the defrosting time is greater than or equal to a maximum defrosting time being greater than the minimum defrosting time.

7. The cooling apparatus according to claim 1, wherein the controller terminates the cooling operation and performs the defrosting operation when a continuous operation time of the compressor is greater than or equal to a maximum cooling time.

8. The cooling apparatus according to claim 7, further comprising a defrosting temperature sensor to sense a temperature of the evaporator, wherein the controller terminates the defrosting operation when the sensed evaporator temperature is above a defrosting termination temperature and the defrosting time is greater than or equal to the minimum defrosting time.

9. The cooling apparatus according to claim 7, wherein the defrosting operation is terminated when the defrosting time is greater than or equal to a maximum defrosting time being greater than the minimum defrosting time.

10. A control method of a cooling apparatus comprising a storage compartment, an evaporator to cool air in the storage compartment by evaporating a refrigerant, a compressor to compress the refrigerant evaporated by the evaporator, and an air blower to supply the air cooled by the evaporator to the storage compartment, the control method comprising:

performing a cooling operation of operating the compressor and the air blower to cool the storage compartment when the temperature of the storage compartment is greater than or equal to an upper limit temperature; and performing a defrosting operation of operating the air blower to remove at least frost formed on the evaporator when the cooling operation is terminated, wherein the defrosting operation is performed for a minimum defrosting time or more, and the cooling operation is prevented when a defrosting time for which the defrosting operation is performed is less than the minimum defrosting time, when the temperature of the storage compartment is above the upper limit temperature after the minimum defrost time has elapsed since the defrosting operation is performed, terminating the defrosting operation and performing the cooling operation, and when the temperature of the storage compartment is below the upper limit temperature after the minimum defrost time has elapsed since the defrosting operation is performed, continuing the defrosting operation.

11. The control method according to claim 10, wherein the minimum defrosting time is changed according to a temperature of external air outside of the storage compartment.

12. The control method according to claim 11, wherein the minimum defrosting time decreases when the temperature of the external air increases.

13. The control method according to claim 10, further comprising terminating the cooling operation and performing the defrosting operation when the temperature of the storage compartment is below a lower limit temperature.

14. The control method according to claim 13, further comprising terminating the defrosting operation when a temperature of the evaporator is above a defrosting termination temperature and the defrosting time is greater than or equal to the minimum defrosting time.

15. The control method according to claim 13, further comprising terminating the defrosting operation when the defrosting time is greater than or equal to a maximum defrosting time being greater than the minimum defrosting time.

16. The control method according to claim 10, further comprising;

terminating the cooling operation and performing the defrosting operation when a continuous operation time of the compressor is greater than or equal to a maximum cooling time.

17. The control method according to claim 16, further comprising terminating the defrosting operation when the temperature of the evaporator is above a defrosting termination temperature and the defrosting time is greater than or equal to the minimum defrosting time.

18. The control method according to claim 16, further comprising terminating the defrosting operation when the defrosting time is greater than or equal to a maximum defrosting time being greater than the minimum defrosting time.

* * * * *